US008350500B2

(12) United States Patent
Negley et al.

(10) Patent No.: US 8,350,500 B2
(45) Date of Patent: Jan. 8, 2013

(54) SOLID STATE LIGHTING DEVICES INCLUDING THERMAL MANAGEMENT AND RELATED METHODS

(75) Inventors: Gerald H. Negley, Chapel Hill, NC (US); Antony P. van de Ven, Sai Kung (HK)

(73) Assignee: Cree, Inc., Durham, NC (US)

( * ) Notice: Subject to any disclaimer, the term of this patent is extended or adjusted under 35 U.S.C. 154(b) by 155 days.

(21) Appl. No.: 12/574,021

(22) Filed: Oct. 6, 2009

(65) Prior Publication Data

US 2011/0080116 A1 Apr. 7, 2011

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| *H05B 37/00* | (2006.01) |
| *H05B 39/00* | (2006.01) |
| *H05B 41/00* | (2006.01) |

(52) U.S. Cl. ..... 315/309; 315/291; 315/312

(58) Field of Classification Search ..... None
See application file for complete search history.

(56) References Cited

U.S. PATENT DOCUMENTS

| | | | | |
|---|---|---|---|---|
| 6,239,716 | B1 | 5/2001 | Pross et al. | |
| 6,717,559 | B2 | 4/2004 | Weindorf | |
| 6,848,819 | B1 | 2/2005 | Arndt et al. | |
| 6,860,621 | B2 | 3/2005 | Bachl et al. | |
| 6,900,471 | B1 | 5/2005 | Wicke et al. | |
| 7,193,299 | B2 | 3/2007 | Arndt et al. | |
| 7,319,298 | B2 | 1/2008 | Jungwirth et al. | |
| 7,439,549 | B2 | 10/2008 | Marchi et al. | |
| 7,456,500 | B2 | 11/2008 | Kromotis et al. | |
| 7,559,674 | B2 * | 7/2009 | He et al. | 362/249.02 |
| 7,560,741 | B2 | 7/2009 | Harle et al. | |
| 2002/0097000 | A1 | 7/2002 | Muthu et al. | |
| 2002/0167637 | A1 | 11/2002 | Burke et al. | |
| 2002/0171365 | A1 * | 11/2002 | Morgan et al. | 315/56 |
| 2002/0195945 | A1 | 12/2002 | Gershen et al. | |
| 2003/0063463 | A1 * | 4/2003 | Sloan et al. | 362/238 |
| 2007/0139319 | A1 * | 6/2007 | Nishida et al. | 345/83 |
| 2007/0279906 | A1 * | 12/2007 | He et al. | 362/253 |
| 2008/0129220 | A1 | 6/2008 | Shteynberg et al. | |
| 2008/0174929 | A1 | 7/2008 | Shen et al. | |
| 2008/0191631 | A1 | 8/2008 | Archenhold et al. | |
| 2008/0197788 | A1 * | 8/2008 | Conover et al. | 315/291 |
| 2009/0013570 | A1 * | 1/2009 | Grajcar | 40/552 |
| 2009/0085494 | A1 * | 4/2009 | Summerland | 315/291 |

(Continued)

OTHER PUBLICATIONS

International Preliminary Report on Patentability for PCT/US2010/049577, report dated Apr. 11, 2012.

*Primary Examiner* — Douglas W Owens
*Assistant Examiner* — Dedei K Hammond
(74) *Attorney, Agent, or Firm* — Myers Bigel Sibley & Sajovec

(57) ABSTRACT

Provided is a solid state lighting apparatus that includes multiple light emitting diodes (LEDs) including at least a first LED and a second LED. The apparatus includes a thermal sensor that is configured to provide a temperature signal corresponding to an operating condition of the solid state lighting apparatus and a control circuit that is configured to receive the temperature signal and to selectively interrupt electrical current to a portion of the plurality of light emitting diodes responsive to the temperature signal including a value that exceeds a high temperature limit.

17 Claims, 4 Drawing Sheets

U.S. PATENT DOCUMENTS

2009/0153075 A1 6/2009 Li et al.
2010/0052542 A1 3/2010 Siemiet et al.
2010/0148701 A1* 6/2010 Yu et al. ..... 315/309
2012/0116759 A1 5/2012 Folkesson et al.

* cited by examiner

SOLID STATE LIGHTING DEVICES INCLUDING THERMAL MANAGEMENT AND RELATED METHODS

FIELD OF THE INVENTION

The present invention relates to solid state lighting, and more particularly to solid state lighting devices and methods for general illumination.

BACKGROUND

Solid state lighting devices are used for a number of lighting applications. For example, solid state lighting panels including arrays of solid state lighting devices have been used as direct illumination sources, for example, in architectural and/or accent lighting. A solid state lighting device may include, for example, a packaged light emitting device (LED) including one or more light emitting diode chips. Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e. electrons and holes, in a light emitting layer or region. LED chips, or dice, can be mounted in many different ways for many different applications. For example, an LED chip can be mounted on a header and enclosed by an encapsulant for protection, wavelength conversion, focusing, dispersion/scattering, etc. LED chips can also be mounted directly to a submount, such as a PCB, and can be coated directly with a phosphor, such as by electrophoresis or other techniques. Accordingly, as used herein, the term "light emitting diode" or "LED" can refer to an LED chip, including an LED chip coated or otherwise provided with phosphor, or to a packaged device, such as a packaged device that includes an LED chip and that provides electrical contacts, primary optics, heat dissipation, and/or other functional features for the LED chip.

Recently solid state lighting systems have been developed for general illumination applications. The design of a solid state lighting system for general illumination typically involves designing optical, power and thermal management systems in order to provide a particular level of performance with respect to lumen output, power requirements and junction temperature of Light Emitting Diode (LED) light sources. The junction temperature of LEDs may be important as it may be a contributing factor in the lifetime of the LEDs. In particular, if the junction temperature exceeds the recommended junction temperature of the manufacturer, then the LEDs will typically not achieve the lifetime rated by the manufacturer. Furthermore, as the operating temperature of LEDs changes, the current through the LEDs may change. For this and other reasons, changes in operating temperature can result in color shifts in the resulting light output. Maintaining a stable operating temperature may, therefore, also benefit in maintaining stable color output of a solid state light source.

Thermal management for solid state lighting systems has generally fallen into two categories: passive systems and active systems. These systems have typically been integral to the lighting device. Thus, for example, the LR6 recessed downlight from Cree LED Lighting Solutions of Morrisville, N.C., utilizes a passive system that incorporates a heat sink that is exposed to the room in which the LR6 is mounted. Thus, the LR6 provides not only the light source but also the trim for a recessed fixture in which the LR6 is mounted. By exposing the heat sink to the room the LR6 benefits from any air currents that break the boundary layer between the heat sink and the air in the room. Breaking the boundary layer between a heat sink and its environment can increase the efficacy of the heat sink, thereby lowering the junction temperature of the LEDs.

Active thermal management for solid state lighting systems has also been utilized. For example, U.S. Pat. No. 7,144,135 entitled "LED Lamp Heat Sink" describes an LED lamp that includes a fan that moves air over a heat sink. Additionally, LED downlights with integral synthetic jet cooling systems have also been announced by Nuventix and Philips. See nuventix.com/news/Nuventix-Announces-SynJet-Fanless-Air-Cooler-for-Philips-Fortimo-LED-Downlight-Module date Apr. 7, 2008 on the World Wide Web. However, current solutions may rely on specifically designed fixtures, structures and/or environments. In this regard, thermal management solutions corresponding to LED modules that may be provided for inclusion in products/devices manufactured by third parties may be inadequate and/or unascertainable.

SUMMARY

Some embodiments of the present invention include solid state lighting apparatus. Such apparatus may include multiple light emitting diodes (LEDs) including at least a first LED and a second LED, a thermal sensor that is configured to provide a temperature signal corresponding to an operating condition of the solid state lighting apparatus, and a control circuit that is configured to receive the temperature signal and to selectively interrupt electrical current to a portion of the light emitting diodes responsive to the temperature signal including a value that exceeds a high temperature limit.

In some embodiments, the control circuit is further configured to change a visible appearance of light emitted from the apparatus via the selective interruption of electrical current to the portion of the solid state light emitting diodes. Some embodiments provide that the control circuit is further configured to interrupt electrical current that is provided by an LED power supply device to the solid state lighting apparatus.

In some embodiments, the solid state light emitting diodes include a first portion of light emitting diodes that are operable to emit light including a first dominant wavelength and a second portion of the light emitting diodes that are operable to emit light including a second dominant wavelength. The control circuit may be configured to interrupt electrical current to the first portion of the light emitting diodes responsive to the temperature signal including the value that exceeds the high temperature limit. In some embodiments, the control circuit is configured to interrupt electrical current to fewer than all of each of the first and the second portions of the light emitting diodes responsive to the temperature signal including the value that exceeds the high temperature limit.

Some embodiments provide that the control circuit is further configured to cease interrupting the current to the portion of the light emitting diodes responsive to the temperature signal including a value that is less than a restore function temperature that is lower than the high temperature limit.

In some embodiments, the solid state light emitting diodes include a first portion of light emitting diodes and a second portion of the light emitting diodes, and the control circuit is configured to alternately interrupt electrical current to the first portion of the light emitting diodes and the second portion of the light emitting diodes responsive to the temperature signal including the value that exceeds the high temperature limit.

Some embodiments provide that the thermal sensor includes a thermistor and/or a resistance temperature detector (RTD) that is operable to change resistance responsive to changes in temperature. In some embodiments, the operating condition includes an emitter junction temperature and/or an environment ambient temperature.

The solid state lighting apparatus may include a LED module included in a self-ballasted lamp. Some embodiments provide that the apparatus includes an illumination module that is configured to be connected to a LED driver circuit and mounted in an application-specific structure.

In some embodiments, the control circuit is configured to interrupt electrical current to the portion of the light emitting diodes for a minimum time independent of a subsequent value of the temperature signal. Some embodiments provide that the control circuit is configured to intermittently interrupt the current to the portion of the solid state light emitting diodes in a temporally specific pattern to provide a visible indicator corresponding to the value of the temperature signal.

Some embodiments of the present invention include methods of thermal management in a solid state lighting apparatus. Such methods may include receiving electrical current into the apparatus to drive multiple light emitting diodes (LEDs) including at least a first portion of LEDs and a second portion of LEDs, generating a temperature signal corresponding to an operating condition of the solid state lighting apparatus, and, responsive to the temperature signal including a value that exceeds a high temperature limit, selectively interrupting the electrical current to the first portion of LEDs.

In some embodiments, selectively interrupting the current flow to the first portion of LEDs includes changing a visible appearance of light emitted from the apparatus. Some embodiments provide that changing the visible appearance of light emitted from the apparatus includes interrupting electrical current to the first portion of light emitting diodes that are operable to emit light including a first dominant wavelength. The second portion of the light emitting diodes may be are operable to emit light including a second dominant wavelength.

Some embodiments include generating an updated temperature signal including a value that is less than a restore function temperature that is lower than the high temperature limit and resuming the electrical current to the first portion of LEDs responsive to receiving the temperature signal including the value that is less than the restore function temperature.

Some embodiments include alternately interrupting electrical current to the first portion of LEDs and then the second portion of LEDs responsive to the temperature signal including the value that exceeds the high temperature limit. In some embodiments, generating a temperature signal corresponding to an operating condition of the solid state lighting apparatus includes receiving a signal generated by a thermistor and/or a resistance temperature detector (RTD) that is operable to change resistance responsive to changes in temperature. Some embodiments provide that the operating condition includes an emitter junction temperature and/or an environment ambient temperature.

In some embodiments, selectively interrupting the electrical current to the first portion of LEDs includes interrupting the electrical current to the first portion of LEDs for a minimum time independent of a subsequent value of the temperature signal. Some embodiments provide that selectively interrupting the current flow to the first portion of LEDs includes intermittently interrupting the electrical current to the first portion of LEDs in a temporally specific pattern to provide a visible indicator corresponding to the value of the temperature signal.

Some embodiments of the present invention include solid state lighting apparatus. Such apparatus may include means for receiving electrical current into the apparatus to drive multiple light emitting diodes (LEDs) including at least a first portion of LEDs and a second portion of LEDs and means for generating a temperature signal corresponding to an operating condition of the solid state lighting apparatus. Some embodiments may include means for selectively interrupting the electrical current to the first portion of LEDs in response to the temperature signal including a value that exceeds a high temperature limit.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION

Figure 1:
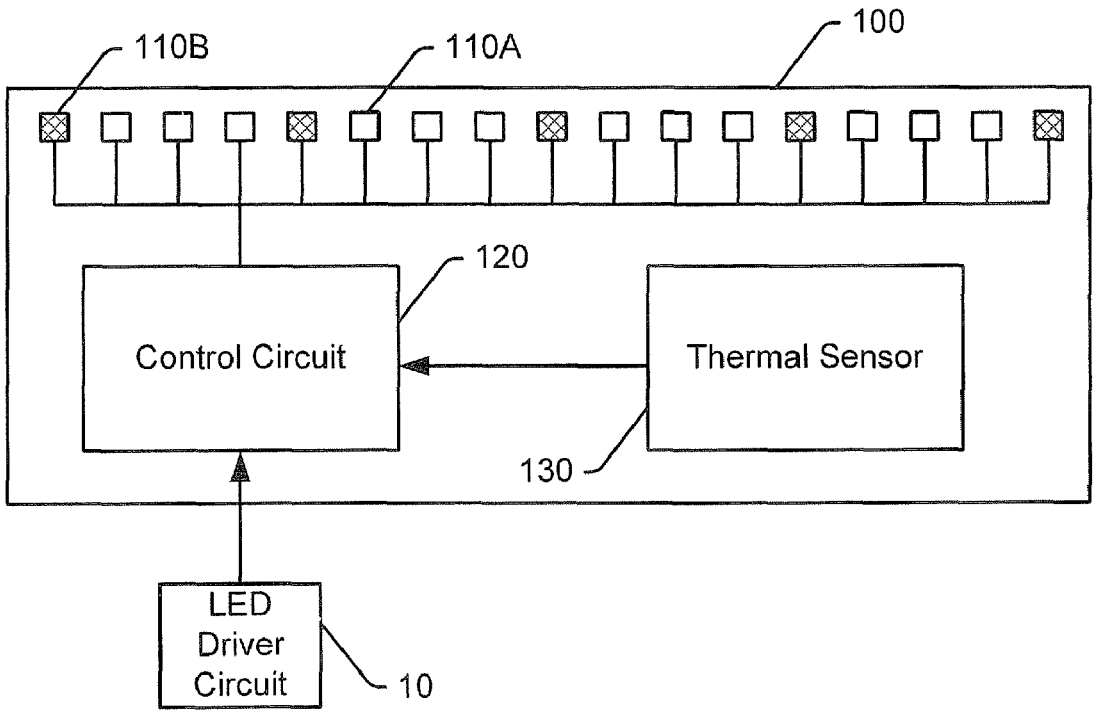
FIG. 1 is a block diagram illustrating a solid state lighting apparatus and driver circuit according to some embodiments of the present invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "front" or "back" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this disclosure and the relevant art and will not be interpreted in an idealized or overly formal sense unless expressly so defined herein.

Reference is now made to FIG. 1, which is a block diagram illustrating a solid state lighting apparatus 100 and LED driver circuit 10 according to some embodiments of the present invention. The lighting apparatus 100 may include multiple solid state light emitters (e.g., diodes, light emitting diodes, LEDs, etc.) 110. Some embodiments provide that the apparatus 100 includes first LEDs 110A and second LEDs 110B. In some embodiments, first and second LEDs 110A and 110B may be configured to include different emission characteristics from one another. For example, lighting apparatus 100 may be a LED module that is configured to emit substantially white light that is a combination of light emitted by first and second LEDs 110A, 110B.

White light can be a mixture of many different wavelengths. There are many different hues of light that may be considered "white". For example, some "white" light, such as light generated by sodium vapor lighting devices, may appear yellowish in color, while other "white" light, such as light generated by some fluorescent lighting devices, may appear more bluish in color.

It is further known that a binary combination of light from two different light sources may appear to have a different color than either of the two constituent colors. The color of the combined light may depend on the relative intensities of the two light sources. For example, light emitted by a combination of a blue source and a red source may appear purple or magenta to an observer. Similarly, light emitted by a combination of a blue source and a yellow source may appear white to an observer.

The ability of a light source to accurately reproduce color in illuminated objects is typically characterized using the color rendering index (CRI). In particular, CRI is a relative measurement of how the color rendering properties of an illumination system compare to those of a black-body radiator. The CRI equals 100 if the color coordinates of a set of test colors being illuminated by the illumination system are the same as the coordinates of the same test colors being irradiated by the black-body radiator. Daylight has the highest CRI (of 100), with incandescent bulbs being relatively close (about 95), and fluorescent lighting being less accurate (70-85).

For backlight and illumination applications, it is often desirable to provide a lighting source that generates white light having a high color rendering index, so that objects illuminated by the lighting source may appear more natural. Accordingly, such lighting sources may typically include an array of solid state lighting devices including red, green and blue light emitting devices. When red, green and blue light emitting devices are energized simultaneously, the resulting combined light may appear white, or nearly white, depending on the relative intensities of the red, green and blue sources. However, even light that is a combination of red, green and blue emitters may have a low CRI, particularly if the emitters generate saturated light, because such light may lack contributions from many visible wavelengths.

In this regard, a lighting apparatus 100 according to some embodiments includes a plurality of light emitting diodes (LEDs) including at least a first LED 110A and a second LED 110B. Chromaticities of the first and second LEDs 110A, 110B may be selected so that a combined light generated by a mixture of light from the pair of LEDs has about a target chromaticity, which may for example be white. In some embodiments, the first LED 110A includes a first LED chip that emits light in the blue portion of the visible spectrum and includes a phosphor, such as a red phosphor, that is configured to receive at least some of the light emitted by the blue LED chip and responsively emit red light. In particular embodiments, the first LED chip may have a dominant wavelength from about 430 nm to about 480 nm, and in some cases from about 450 nm to about 460 nm, and the phosphor may emit light having a dominant wavelength from about 600 nm to about 630 nm in response to light emitted by the first LED. The second LED 110B may emit light having a color point that lies in a green, yellowish green or green-yellow portion of the 1931 CIE Chromaticity Diagram.

In some embodiments, the lighting apparatus 100 may include LED/phosphor combinations as described in U.S. Pat. No. 7,213,940, issued May 8, 2007, and entitled "LIGHTING DEVICE AND LIGHTING METHOD," the disclosure of which is incorporated by reference as if set forth fully herein. As described therein, a lighting apparatus 100 may include solid state light emitters (i.e., LED chips) that emit light having dominant wavelength in ranges of from 430 nm to 480 nm, and a group of phosphors that emit light having dominant wavelength in the range of from 555 nm to 585 nm. A combination of light by the first group of emitters, and light emitted by the group of phosphors produces a sub-mixture of light that is referred to herein as "blue-shifted yellow" or "BSY". Such non-white light may, when combined with light having a dominant wavelength from 600 nm to 630 nm, produce warm white light.

Some embodiments provide that the lighting apparatus 100 may further include a third LED chip (not illustrated) that emits light in the blue or green portion of the visible spectrum and that has a dominant wavelength that may be at least about 10 nm greater than a dominant wavelength of the first LED chip. That is, a third LED chip may be provided that may "fill in" some of the spectral gaps that may be present in light emitted by the lighting device, to thereby improve the CRI of the device. The third LED chip may have a dominant wavelength that may be at least about 20 nm greater, and in some embodiments about 50 nm or more greater, than the dominant wavelength of the first LED chip.

A lighting apparatus 100 as described herein may include a linear illumination module that includes multiple surface mount technology (SMT) packaged LEDs arranged in an array, such as a linear array, on a printed circuit board (PCB), such as a metal core PCB (MCPCB), a standard FR-4 PCB, or a flex PCB. The LEDs may include, for example, XLamp® brand packaged LEDs available from Cree, Inc., Durham, N.C. The array can also include a two-dimensional array of LEDs.

Although not illustrated, a support member may be provided to provide mechanical retention and/or thermal transfer to a surface on which the module may be mounted. Other passive or active electronic components may be additionally mounted on the PCB and connected to serve a particular function. Such components can include resistors, diodes, capacitors, transistors, thermal sensors, optical sensors, amplifiers, microprocessors, drivers, digital communication devices, RF or IR receivers or transmitters and/or other components, for example. The module may include openings that may be covered by one or more optical sheets and/or structures. Additionally, although not illustrated, optical sheets may include a simple transmissive diffuser, a surface embossed holographic diffuser, a brightness enhancing film (BEF), a Fresnel lens, TIR or other grooved sheet, a dual BEF (DBEF) or other polarizing film, a micro-lens array sheet, or other optical sheet. Reflective sheets, films, coatings and/or surfaces may also be provided in some embodiments.

Thus, as described above, first LEDs 110A may be configured to emit substantially white light using, for example, a BSY LED (BSY) and second LEDs 110B may be configured to emit light having a dominant wavelength from 600 nm to 630 nm (red).

The lighting apparatus 100 may include a control circuit 120 that is configured to receive electrical current from a LED driver circuit 10 that may not be part of the lighting apparatus 100. For example, in some embodiments, the lighting apparatus 100 may be a LED module that is provided to a device and/or system manufacturer to be used in an application and/or environment, the characteristics of which may be unascertainable to the LED module supplier. Accordingly, the LED module supplier may lack knowledge regarding application and/or environmental conditions that may exceed a design and/or test standard corresponding to the LED module. For example, an LED module may be rated to include an operating life that is dependent on specific operating conditions, such as, for example, temperature. The device and/or system may be designed to include the LED driver 10 as a separate device/system component.

To detect and/or indicate one or more operating conditions that exceed those designated by a LED module manufacturer, the lighting apparatus 100 may include a thermal sensor 130 that is configured to provide a temperature signal corresponding to an operating condition of the lighting apparatus 100. In some embodiments, an operating temperature may include a junction temperature corresponding to one or more of the light emitting diodes 110A, B. Some embodiments provide that an operating temperature may include an ambient temperature corresponding to an operating environment. A thermal sensor may include a thermistor, a resistance temperature detector (RTD), and/or a thermocouple, among others.

The control circuit 120 may be configured to receive the temperature signal from the thermal sensor 130 and selectively interrupt electrical current to a portion of the LEDs 110A, B. For example, if a value of the temperature signal exceeds a high temperature limit, electrical current to the first LEDs 110A may be interrupted to cause the first LEDs to turn off. Once the first LEDs 110A are turned off, the characteristics of the light emitted from the lighting apparatus 100 may be determined solely by the characteristics of the second LEDs 110B, which may continue to operate. In this regard, where the first LEDs 110A are BSY and the second LEDs 110B are red, interrupting the electrical current to the first LEDs 110A may cause the lighting apparatus 100 to emit substantially red light. Accordingly, some embodiments provide that the control circuit 120 is configured to change the visible appearance of the light emitted from the lighting apparatus 100 responsive to a high temperature operating condition.

In some embodiments, the control circuit 120 may be further configured to continue to receive and/or update a temperature signal from the thermal sensor 130 even after a high temperature condition is detected and the first LEDs 110A are turned off. If, after interrupting electrical current to the first LEDs 110A, the value of the temperature signal decreases, indicating a reduction in the operating temperature, the electrical current may be resumed to the first LEDs 110A. In some embodiments, a restore function temperature value may be defined to trigger the restoration of the electrical current to the first LEDs 110A. For example, a restore function temperature value may be less than the high temperature limit such that a hysteresis control characteristic may be provided.

Some embodiments provide that the control circuit 120 may include comparator functions and/or devices for comparing the received temperature signal to the high temperature limit and/or the restore function temperature. In some embodiments, outputs from the comparator functions and/or devices may be received by latching circuits including bistable multivibrator circuits, among others. For example, in some embodiments a set-reset (SR) flip-flop may be used to change, set, and/or maintain an output state corresponding to a value of the temperature signal relative to the high temperature limit and/or the restore function temperature.

Some embodiments provide that interruption of the electrical current to the first LEDs 110A may be continued for a minimum time interval regardless of an updated subsequent value of the temperature signal. For example, once the temperature signal exceeds the high temperature signal, the electrical current to the first LEDs 110A may be interrupted for some fixed time interval including a specified number of seconds, minutes and/or hours. In some embodiments, the fixed time interval may be triggered from the time that the current is interrupted and/or from the time that the temperature signal value is less than the restore function temperature.

Some embodiments provide that the control circuit 120 is configured to intermittently interrupt the electrical current to the first LEDs 110A. For example, in some embodiments, more than one high temperature limit value may be provided and the control circuit may be configured to interrupt the current at an first interval corresponding to a first high temperature limit and a second interval corresponding to a second high temperature limit. In some embodiments, the current interruption may be alternating with non-interrupted intervals to create an on/off sequence. For example, in response to the temperature signal exceeding the first high temperature limit, the control circuit 120 may be configured to interrupt the electrical current to the first LEDs 110A for a ten second duration every twenty seconds. In contrast, in response to the temperature signal exceeding the second high temperature limit, the control circuit 120 may be configured to interrupt the electrical current to the first LEDs 110A for a one second duration every two seconds. In some embodiments, the first high temperature limit may correspond to an emitter junction temperature and/or the second high temperature may correspond to an ambient temperature, among others. In this manner, a visible appearance of the lighting apparatus 100 may change in different ways to signal different respective operating conditions.

Some embodiments provide that electrical current to third LED's (not illustrated) may be interrupted instead of and/or in combination with that of the first and/or second LEDs 110A, B to provide other similar visible appearance changes responsive to the detection of different respective operating conditions.

Although embodiments described herein are generally described in terms of responding to thermal energy-related operating conditions, the disclosure is not so limited. For example, in some embodiments, instead of a thermal sensor, a humidity sensor may be used to provide a moisture signal, which may be compared to a humidity threshold. In this regard, the visible characteristics of the light emitted from a lighting apparatus may be changed responsive to a high humidity operating condition.

Figure 2A:
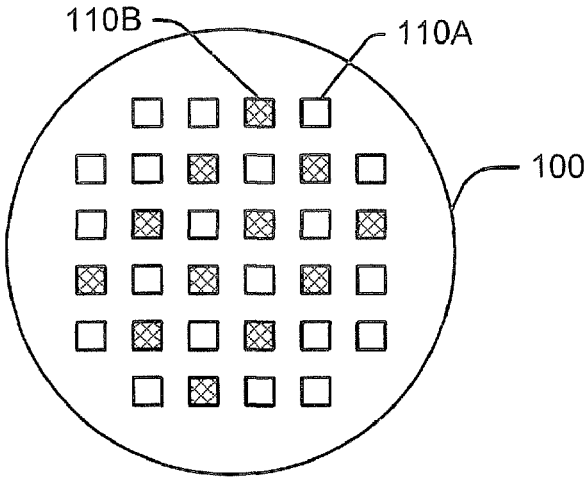
FIGS. 2A and 2B are front views of different respective configurations of a solid state lighting apparatus according to some embodiments of the present invention.
Figure 2B:
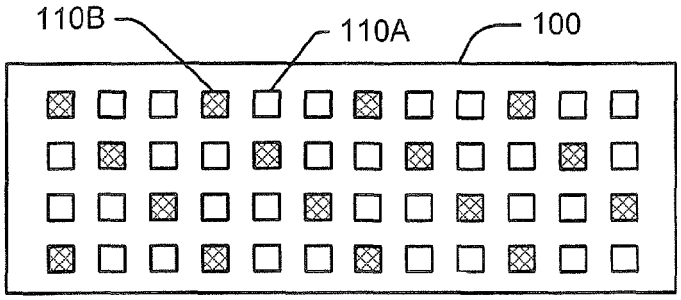

Reference is now made to FIGS. 2A and 2B, which are front views of different respective configurations of a solid state lighting apparatus according to some embodiments of the present invention. The solid-state lighting apparatus 100 may include a plurality of first LEDs 110A and a plurality of second LEDs 110B. In some embodiments, the plurality of first LEDs 110A may include white emitting and/or non-white emitting, light emitting devices. The plurality of second LEDs 110B may include light emitting devices that emit light having a different dominant wavelength from the first LEDs 110A, so that combined light emitted by the first LEDs 110A and the second LEDs 110B may have a desired color and/or spectral content.

For example, the combined light emitted by the plurality of first LEDs 110A and the plurality of second LEDs 110B may be warm white light that has a high color rendering index.

Blue and/or green LED chips used in a lighting apparatus according to some embodiments may be InGaN-based blue and/or green LED chips available from Cree, Inc., the assignee of the present invention. For example, the LED chips may include EZBright® power chips manufactured by Cree, Inc. EZBright® power chips have been demonstrated with an external quantum efficiency (i.e., the product of internal quantum efficiency and light extraction efficiency) as high as 50% at 50 A/cm$^2$ corresponding to greater than 450 mW of optical output power at 350 mA drive current. Red LEDs used in the lighting apparatus may be, for example, AlInGaP LED chips available from Epistar, Osram and others.

As discussed above regarding FIG. 1, when a control circuit (120 FIG. 1) receives a temperature signal that indicates an operating condition that exceeds a predefined threshold, the electrical current to the first LEDs 110A may be interrupted. As illustrated in FIGS. 2A and 2B, since the light emitted from the lighting apparatus 100 includes a combined light from first LEDs 110A and second LEDs 110B that include different emission characteristics from the first LEDs 110A, when the electrical current is interrupted to the first LEDs 110A, the light emitted from the lighting apparatus 100 changes to include emission characteristics of the second LEDs 110B only.

Figure 3A:
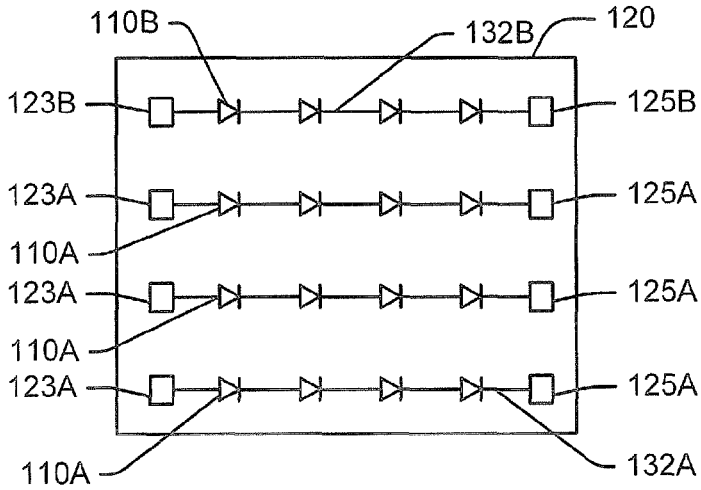
FIGS. 3A and 3B are schematics of emitter strings of different respective configurations of a solid state lighting apparatus according to some embodiments of the present invention.
Figure 3B:
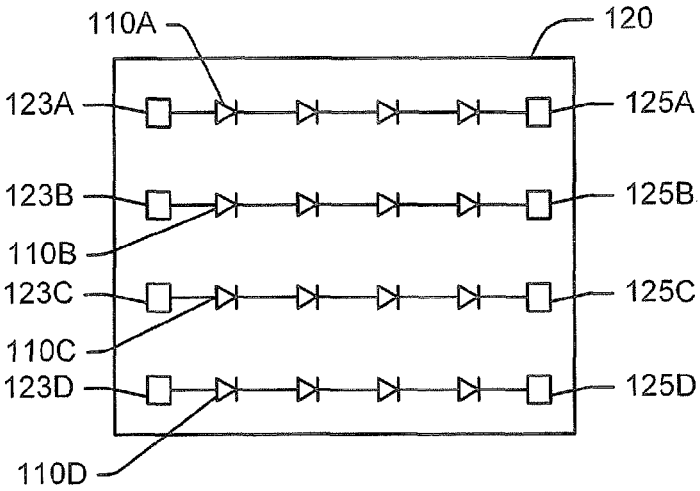

Reference is now made to FIGS. 3A and 3B, which are schematic diagrams of emitter strings of different respective configurations of a solid state lighting apparatus according to some embodiments of the present invention. Referring to FIG. 3A, the LEDs 110A, 110B in the lighting apparatus 100 may be electrically interconnected in respective strings. As shown therein, the LEDs 110A, 110B may be interconnected such that the LEDs 110A are connected in series to form first strings 132A. Likewise, the LEDs 110B may be arranged in series to form a second string 132B. Each string 132A, 132B may be connected to respective anode terminals 123A, 123B and cathode terminals 125A, 125B.

Although four strings 132A, 132B are illustrated in FIG. 3A, it will be appreciated that the lighting apparatus 100 may include more or fewer strings. Furthermore, there may be multiple strings of LEDs 110A, and/or multiple strings of other colored LEDs 110B. Some embodiments provide that electrical current may be selectively interrupted for each of the strings 132A, 132B in any combination. In this manner, a control circuit may selectively interrupt electrical current to strings 132A, for example, while allowing strings 132B to be energized in response to an operating condition that exceeds an established limit. By selectively interrupting the electrical current to the first LEDs 110A responsive to the operating condition, the light emitted from the lighting apparatus 100 may change in visible appearance.

Referring to FIG. 3B, the LEDs 110A, 110B, 110C, 110D in the lighting apparatus 100 may be electrically interconnected in respective strings. As shown therein, the LEDs 110A, 110B, 110C, 110D may be interconnected such that the LEDs 110A are connected in series to form a first string 132A. Likewise, the LEDs 110B may be arranged in series to form a second string 132B, the LEDs 110C may be arranged in series to form a third string 132C, and the LEDs 110D may be arranged in series to form a fourth string 132D. Each string 132A, 132B, 132C, 132D may be connected to respective anode terminals 123A, 123B, 123C, 123D and cathode terminals 125A, 125B, 125C, 125D.

Although four strings 132A, 132B, 132C, 132D are illustrated in FIG. 3B, it will be appreciated that the lighting apparatus 100 may include more or fewer strings. Furthermore, there may be multiple strings of LEDs 110A, multiple strings of other colored LEDs 110B, multiple strings of yet other colored LEDs 110C and/or multiple strings of yet other colored LEDs 110D. Some embodiments provide that electrical current may be selectively interrupted for each of the strings 132A, 132B, 132C, 132D in any combination. In this manner, a control circuit may selectively interrupt electrical current to string 132A, for example, while allowing strings 132B, 132C, 132D to be energized in response to an operating condition that exceeds an established limit. In the event that an undesirable operating condition is persistent, a control circuit may alternate the selective interruption among multiple ones of the strings 132A, 132B, 132C, 132D. For example, electrical current to string 132A may be interrupted for a determined time interval and then restored while electrical current to string 132B is interrupted. By effectively rotating which of the strings 132A, 132B, 132C, 132D are energized during the undesirable operating condition, potential life shortening and/or performance diminishing effects to any one or set of strings may be reduced and/or equalized among all of the strings.

Additionally, although examples described herein are generally directed to binary groupings of color, it will be appreciated that ternary, quaternary and higher-order versions may also be utilized, in which a metameric grouping includes three or more LED device types.

Figure 4:
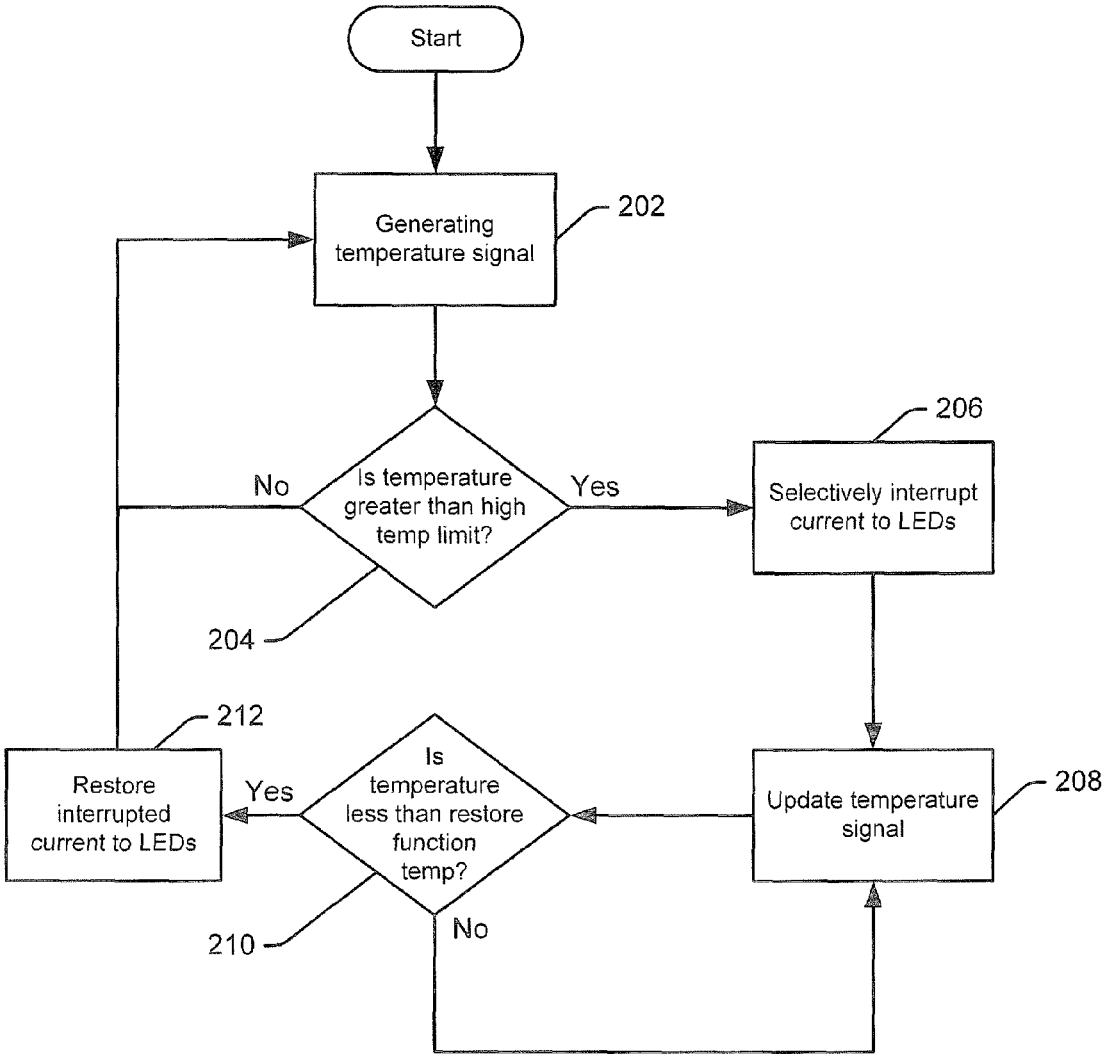
FIG. 4 is a block diagram illustrating exemplary control logic of a solid state lighting apparatus and/or methods of thermal management according to some embodiments of the present invention.

Reference is now made to FIG. 4, which is a block diagram illustrating exemplary control logic of a solid state lighting apparatus and/or methods of thermal management according to some embodiments of the present invention. A temperature signal corresponding to an operating condition of a solid state lighting apparatus is generated (block 202). Some embodiments provide that the temperature signal may correspond to a junction temperature of one or more solid state emitters (e.g., LEDs) in the lighting apparatus. In some embodiments, the temperature may correspond to an ambient temperature. The temperature signal may be generated by a thermal sensor including a thermistor, RTD, and/or thermocouple, among others.

Whether the temperature is greater than a high temperature limit is determined (block 204). In some embodiments, the value corresponding to the temperature signal may be compared to the value corresponding to the high temperature limit using a comparator function, circuit and/or device. Some embodiments provide that the high temperature limit may correspond to a fixed value while some embodiments may provide that the high temperature limit may be variable, adjustable and/or selectable from a plurality of values. If the temperature is not greater than the high temperature limit then the lighting apparatus continues to operate according to normal conditions and the temperature signal is generated to provide an updated temperature value (block 202).

If the temperature is greater than the high temperature limit then the electrical current is interrupted to selective ones of the LEDs to turn those LEDs off (block 206). In some embodiments, the turned off LEDs may be operable to emit light in a dominant wavelength that is different than the dominant wavelength of light emitted from ones of the LEDs that are not turned off. In this manner, the light emitted from the lighting apparatus changes from a combined light corresponding to a combination of the different wavelengths to a light corresponding to less than the total combined different wavelengths. For example, the lighting apparatus may include a first portion of LEDs that are operable to emit substantially non-white light using, for example, a BSY emitter, and a second portion of LEDs that are operable to emit substantially red light. In response to the high temperature condition, the BSY LEDs may be turned off while the red LEDs may continue to emit light. Accordingly, the light emitted from the lighting apparatus will shift from a warm white light to a substantially red light responsive to a high temperature condition.

The temperature signal may be continuously and/or intermittently updated (block 208). Once the electrical current is selectively interrupted to a portion of the LEDs, whether the updated temperature value is less than a restore function temperature value is determined (block 210). If the temperature value is not less than the restore function temperature then the temperature signal may be continuously and/or intermittently updated (block 208). If the updated temperature value is less than the restore function temperature value then the electrical current that was interrupted to the portion of LEDs may be restored (block 212). In some embodiments, a minimum interruption time interval may be provided that maintains the interruption of the electrical current for a minimum time independent of the updated temperature value relative to the restore function temperature. After the electrical current is restored to the previously turned off LEDs, the lighting apparatus may continue to operate according to normal conditions and the temperature signal may be generated to provide an updated temperature value (block 202).

Figure 5:
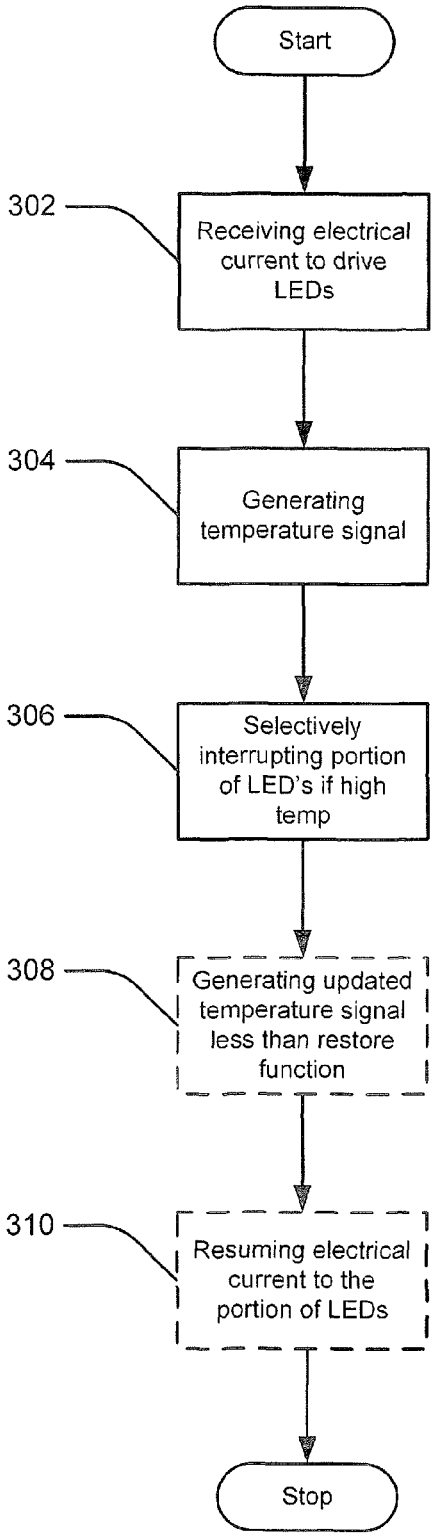
FIG. 5 is a block diagram illustrating operations for providing thermal management in a solid state lighting apparatus according to some embodiments of the present invention.

Reference is now made to FIG. 5, which is a block diagram illustrating operations for providing thermal management in a solid state lighting apparatus according to some embodiments of the present invention. Operations include receiving electrical current into the lighting apparatus to drive multiple light emitting diodes (LEDs) therein. (block 302). The LEDs may include a first portion of LEDs and a second portion of LEDs.

A temperature signal may be generated that corresponds to an operating condition of the lighting apparatus (block 304). Some embodiments provide that the temperature signal may correspond to a junction temperature of one or more solid state emitters (e.g., LEDs) in the lighting apparatus. In some embodiments, the temperature may correspond to an ambient temperature. The temperature signal may be generated by a thermal sensor including a thermistor, RTD, and/or thermocouple, among others.

If the temperature signal includes a value that exceeds a high temperature limit, the electrical current supplied to the first portion of LEDs may be interrupted (block 306). In this regard, the first portion of LEDs are turned off responsive to a high temperature condition.

In some embodiments, the first portion of LEDs may be operable to emit light in a dominant wavelength that is different than the dominant wavelength of light emitted from ones of the second portion of LEDs. In this manner, the light emitted from the lighting apparatus changes from a combined light corresponding to a combination of the different wavelengths to a light corresponding to less than the combined different wavelengths. For example, the first portion of LEDs may be operable to emit substantially white light using, for example, BSY emitters and the second portion of LEDs may be operable to emit substantially red light. Thus, in response to the high temperature condition, the BSY LEDs may be turned off while the red LEDs may continue to emit light. Accordingly, the light emitted from the lighting apparatus will shift from a warm white light corresponding to the combination of the BSY and red LEDs to a substantially red light responsive to a high temperature condition. In this manner, a visible appearance of the light emitted from the lighting apparatus may be changed responsive to the high temperature condition.

Optionally, some embodiments provide that, after the electrical current to the first portion of LEDs is interrupted, an updated temperature signal that includes a value that is less than a restore function value is generated (block 308). In such optional embodiments, the electrical current may be resumed to the first portion of LEDs (block 310). In some embodiments, a minimum time interval may be determined during which the electrical current is not resumed regardless of the value of the updated temperature signal. Some embodiments provide that selectively interrupting the electrical current to the first portion of LEDs includes intermittently interrupting the electrical current in a temporally specific pattern to provide a visible indicator corresponding the value of the temperature signal. In some embodiments, multiple different temporally specific patterns may be used to indicate different respective values of the temperature signal.

In the drawings and specification, there have been disclosed typical embodiments of the invention and, although specific terms are employed, they are used in a generic and descriptive sense only and not for purposes of limitation, the scope of the invention being set forth in the following claims.

What is claimed is:

1. A solid state lighting apparatus comprising:

a plurality of light emitting diodes (LEDs) comprising a first portion of light emitting diodes that are operable to emit light including a first dominant wavelength and a second portion of the light emitting diodes that are operable to emit light including a second dominant wavelength;

a thermal sensor that is configured to provide a temperature signal corresponding to an operating condition of the solid state lighting apparatus; and a control circuit that is coupled to the plurality of light emitting diodes and that is configured to receive the temperature signal and to interrupt electrical current to fewer than all of each of the first and the second portions of the plurality of light emitting diodes responsive to the temperature signal.

2. The solid state lighting apparatus of claim 1, wherein the control circuit is further configured to change a visible appearance of light emitted from the apparatus via the selective interruption of electrical current to the first portion of the plurality of light emitting diodes.

3. The solid state lighting apparatus of claim 1, wherein the control circuit is further configured to interrupt electrical current that is provided by an LED power supply device to the solid state lighting apparatus.

4. The solid state lighting apparatus of claim 1, wherein the control circuit is further configured to cease interrupting the current to the first portion of the plurality of light emitting diodes responsive to the temperature signal including a value that is less than a restore function temperature that is lower than the high temperature limit.

5. The solid state lighting apparatus of claim 1, wherein the control circuit is configured to alternately interrupt electrical current to the first portion of the plurality of light emitting diodes and the second portion of the plurality of light emitting diodes responsive to the temperature signal.

6. The solid state lighting apparatus of claim 1, wherein the thermal sensor comprises a thermistor and/or a resistance temperature detector (RTD) that is operable to change resistance responsive to changes in temperature.

7. The solid state lighting apparatus of claim 1, wherein the operating condition comprises an emitter junction temperature and/or an environment ambient temperature.

8. The solid state lighting apparatus of claim 1, wherein the solid state lighting apparatus comprises a LED module included in a self-ballasted lamp.

9. The solid state lighting apparatus of claim 1, wherein the apparatus comprises an illumination module that is configured to be connected to a LED driver circuit and mounted in an application-specific structure.

10. A solid state lighting apparatus comprising:

a plurality of light emitting diodes (LEDs) comprising a first portion of light emitting diodes that are operable to emit light including a first dominant wavelength and a second portion of the light emitting diodes that are operable to emit light including a second dominant wavelength;

a thermal sensor that is configured to provide a temperature signal corresponding to an operating condition of the solid state lighting apparatus; and a control circuit that is coupled to the plurality of light emitting diodes and that is configured to receive the temperature signal and to interrupt electrical current to the first portion of the plurality of light emitting diodes for a minimum time independent of a subsequent value of the temperature signal.

11. A solid state lighting apparatus comprising:

a plurality of light emitting diodes (LEDs) comprising a first portion of light emitting diodes that are operable to emit light including a first dominant wavelength and a second portion of the light emitting diodes that are operable to emit light including a second dominant wavelength;

a thermal sensor that is configured to provide a temperature signal corresponding to an operating condition of the solid state lighting apparatus; and a control circuit that is coupled to the plurality of light emitting diodes and that is configured to receive the temperature signal and to intermittently interrupt electrical current to the first portion of the plurality of the light emitting diodes in one of a plurality of temporally specific patterns to provide a visible indicator corresponding to a value of the temperature signal, wherein the plurality of temporally specific patterns correspond to respective ones of a plurality of different temperature signal values.

12. A method of thermal management in a solid state lighting apparatus, the method comprising:

receiving electrical current into the apparatus to drive a plurality of light emitting diodes (LEDs) including at least a first portion of LEDs and a second portion of LEDs;

generating a temperature signal corresponding to an operating condition of the solid state lighting apparatus; and responsive to the temperature signal, selectively interrupting the electrical current to the first portion of LEDs, wherein selectively interrupting the electrical current to the first portion of LEDs comprises interrupting the electrical current to the first portion of LEDs for a minimum time independent of a subsequent value of the temperature signal.

13. The method of claim 12, wherein selectively interrupting the current flow to the first portion of LEDs comprises changing a visible appearance of light emitted from the apparatus.

14. The method of claim 12, further comprising:

generating an updated temperature signal including a value that is less than a restore function temperature that is lower than the high temperature limit; and resuming the electrical current to the first portion of LEDs responsive to receiving the temperature signal including the value that is less than the restore function temperature.

15. The method of claim 12, further comprising alternately interrupting electrical current to the first portion of LEDs and then the second portion of LEDs responsive to the temperature signal.

16. The method of claim 12, wherein generating a temperature signal corresponding to an operating condition of the solid state lighting apparatus comprises receiving a signal generated by a thermistor and/or a resistance temperature detector (RTD) that is operable to change resistance responsive to changes in temperature.

17. The method of claim 12, wherein the operating condition includes an emitter junction temperature and/or an environment ambient temperature.

* * * * *